United States Patent [19]

Blazey

[11] 4,205,321

[45] May 27, 1980

[54] DC BIASED STYLUS FOR ELECTROSTATIC RECORDING

[75] Inventor: Richard N. Blazey, Rochester, N.Y.

[73] Assignee: Eastman Kodak Company, Rochester, N.Y.

[21] Appl. No.: 947,913

[22] Filed: Oct. 2, 1978

[51] Int. Cl.[2] ..... G03G 15/052

[52] U.S. Cl. ..... 346/153

[58] Field of Search ..... 346/153, 154, 159, 160; 358/300

[56] References Cited

U.S. PATENT DOCUMENTS

| | | | |
|---|---|---|---|
| 3,208,076 | 9/1965 | Mott | 358/300 |
| 3,234,561 | 2/1966 | Stone, Jr. | 358/300 |
| 3,247,517 | 4/1966 | Stone, Jr. | 358/300 |
| 3,289,209 | 11/1966 | Schwertz | 346/153 |
| 3,301,947 | 1/1967 | Stone | 346/160 |
| 3,694,571 | 9/1972 | Smith | 358/300 |

*Primary Examiner*—John H. Wolff

*Attorney, Agent, or Firm*—Warren W. Kurz

[57] ABSTRACT

In an electrostatic stylus recorder, a DC biased RF field is produced between the writing styli and the dielectric recording element. The DC bias prevents charged gas ions from bombarding and thereby abrading the dielectric recording element during electrical discharge between the styli and the recording element.

7 Claims, 8 Drawing Figures

FIG. 1
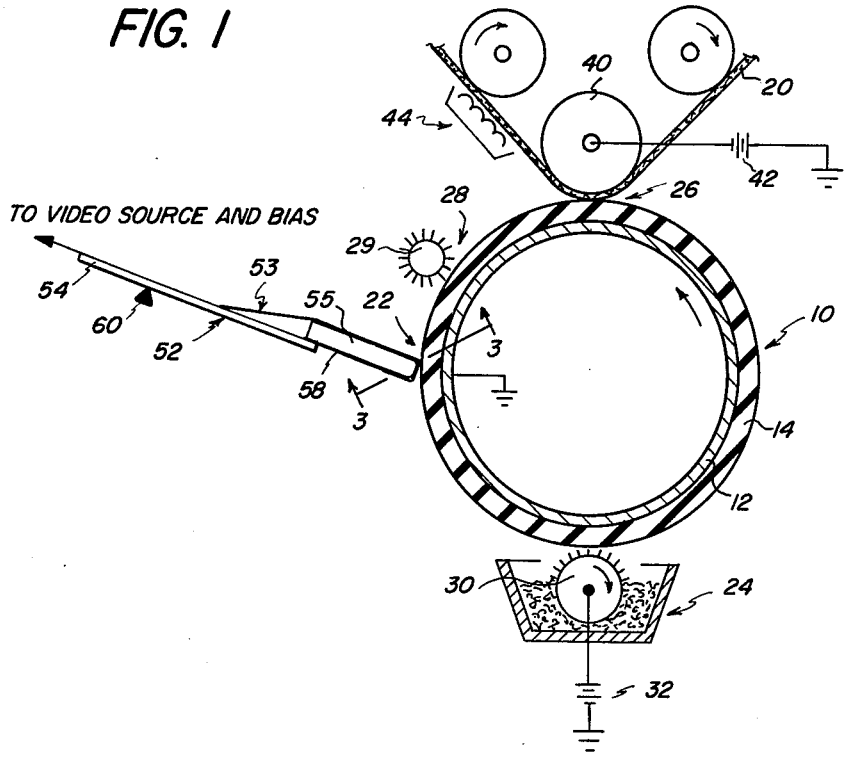
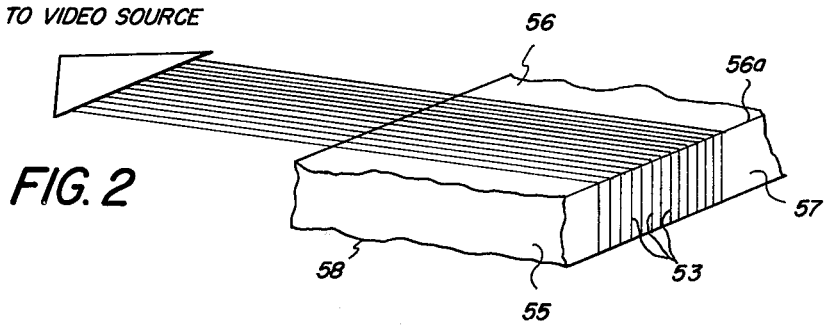
FIG. 2
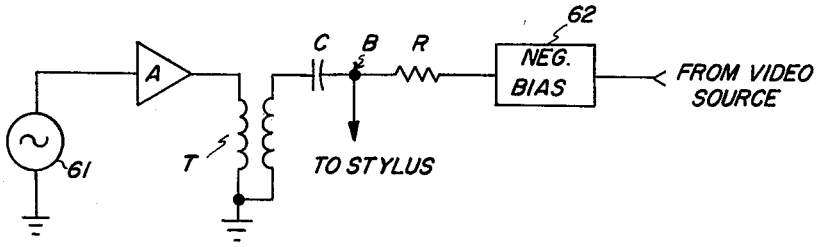
FIG. 4

FIG. 3
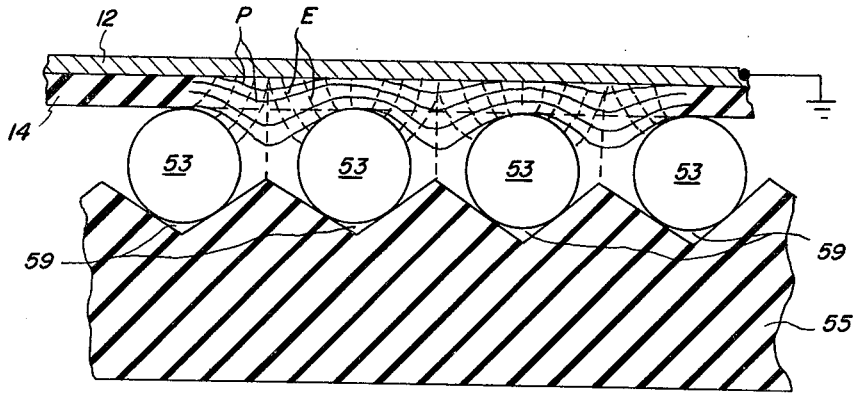
FIG. 5
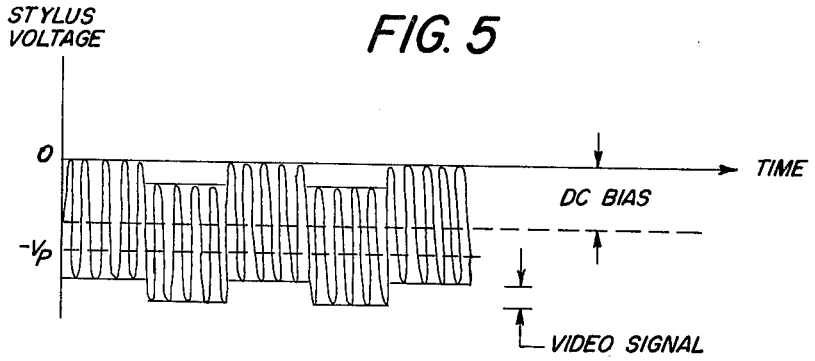
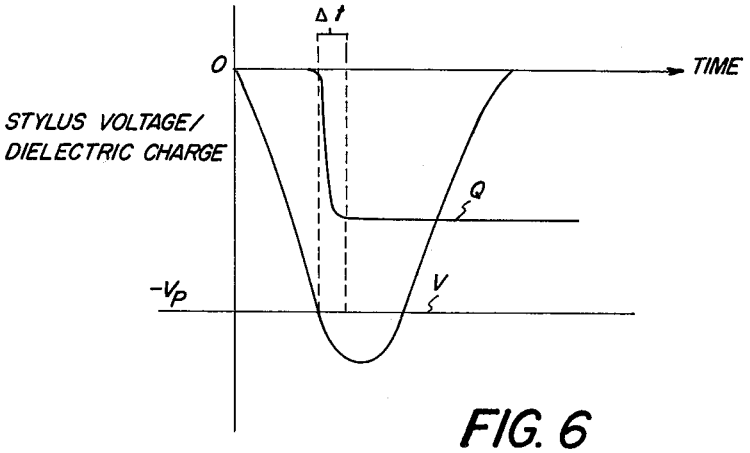
FIG. 6

DC BIASED STYLUS FOR ELECTROSTATIC RECORDING

BACKGROUND OF THE INVENTION

The invention relates to improvements in electrostatus stylus recording apparatus, and more particularly, to apparatus for reducing wear of a reusable dielectric recording element.

In U.S. Pat. No. 3,045,644, issued to F. A. Schwertz, there is disclosed an electrostatic stylus recorder which includes a reusable dielectric recording element in the form of a rotatably driven, dielectric-coated, metallic drum. Electrostatic images are formed on the drum by the collective action of a plurality of closely spaced, electrically conductive styli which are arranged to form a linear array spanning the width of the drum. The ends of the styli are positioned in contact with the dielectric surface of the recording element. When a high voltage electrical signal, representative of video information, is applied to each stylus, an electrical discharge occurs between the stylus tip and the metallic drum. During this discharge, electrical charges are deposited on the interposed surface of the dielectric coating. By controlling the application of video signals to the individual styli, an electrostatic image represenative of the video information being recorded is formed on the dielectric surface of the drum. This charge image is developed by conventional eletrographic techniques, and the resulting visible image is transferred to a paper support. The transfer step allows the dielectric drum to be repetitively cycled through the recording process to form a multitude of transferrable images.

In U.S. Pat. No. 3,301,947 issued to J. J. Stone, it is disclosed that the video signal levels required to effect the electrical discharges which characterize electrographic stylus recording can be significantly reduced by creating an RF field between the stylus tips and the conductive backing of the recording element. This RF field is of an amplitude sufficient to ionize the air in the vicinity of the stylus tip. The ionized air provides a conductive path through which current controlled by the video signal source can travel from the stylus to the dielectric surface. By using an RF field with a zero-volt symmetry, no net charge is transferred to the dielectric surface because that charge which is applied during each half-cycle of the RF field is neutralized by the charge of opposite polarity applied during the other half-cycle. Thus, only when video signals are applied to the styli does a net charge deposition result. In contrast to the aforementioned Schwertz recorder, Stone's apparatus does not feature a reusable recording element; rather, Stone forms and develops electrostatic images directly on dielectric-coated paper.

In applying Stone's teaching to electrographic stylus recorders of the type which employ reusable recording elements, one finds that an unbiased (i.e. zero symmetry) RF field has a deleterious effect on the useful life of the recording element. More specifically, one finds that undesirable grooves are gradually worn in the dielectric surface opposite each stylus tip and that, after a relatively short period of usage, e.g., ten thousand cycles of operation, the grooves are of such depth that the recording element can no longer be used to produce high quality images. I have found that these wear grooves are the result of periodic ion-bombardment which occurs during each half-cycle of the RF field. During each cycle of the RF field, relatively massive, positively charged, gas ions are accelerated by the electric field and alternately bombard the stylus tip and the dielectric surface. Such ion bombardment acts to etch away the dielectric surface and, to a lesser degree, the stylus tip.

SUMMARY OF THE INVENTION

In accordance with the present invention, apparatus is provided for extending the useful life of a resuable dielectric recording element of the type used in electrostatic stylus recording systems. According to the invention, a negatively biased RF field is provided between each recording stylus and the dielectric surface of the recording element. Preferably, the negative bias is selected so that, during the application of the RF field, the dielectric surface never becomes significantly negative with respect to the stylus, and, hence is never more attractive to the positive ions of the RF-produced plasma than the stylus. According to another feature of the invention, stylus wear is minimized by using an RF signal comprising a pulse train having a low (e.g. less than 20%) duty-cycle.

The various objects and advantages of the present invention will be better understood from the ensuing detailed description of a preferred embodiment, reference being made to the accompanying drawings.

BRIEF DESCRIPTION OF THE DRAWINGS

FIG. 1 is a schematic illustration of an electrostatic stylus recorder of the type in which the invention has utility;

FIG. 2 is a perspective view of a portion of an electrostatic stylus recording head;

FIG. 3 is an enlarged cross-sectional view of a portion of the recording head depicted in FIG. 2 taken along the section line 3—3, showing the potential and field lines associated with the styli;

FIG. 4 is an electrical schematic of circuitry for driving each stylus of the recording head depicted in FIG. 2;

FIG. 5 is a waveform characteristic of that produced by the FIG. 4 circuitry;

FIG. 6 is a plot of dielectric surface charge and stylus voltage as a function of time;

DETAILED DESCRIPTION OF A PREFERRED EMBODIMENT

Figure 7:
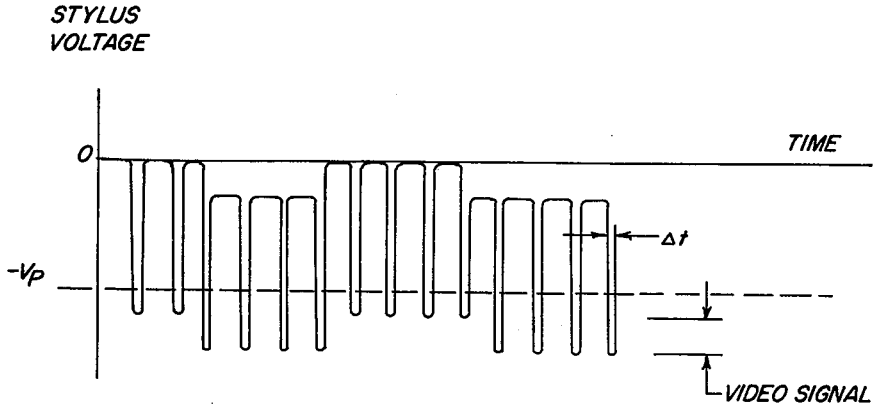
FIG. 7 is an alternate waveform for driving the recording styli.

An electrographic stylus recorder of the type in which the invention has utility is schematically illustrated in FIG. 1. The recorder includes a cylindrical recording element 10 which is rotatably mounted and driven in the direction of the arrow by conventional motor means (not shown). Recording element 10 comprises an electrically conductive core 12 which supports a dielectric layer 14. The latter may comprise, for instance, a one-half mil thick film of tensilized polyethylene terephthalate having an aluminized backing which is positioned in electrical contact with core 12. Core 12 is connected to a reference potential, typically ground potential.

Positioned around the periphery of cylindrical recording element 10 are the various processing stations of the recorder which serve to repetitively form and develop electrostatic images on the outer surface of dielectric layer 14, and to transfer such developed images to a paper web 20. Basically, such stations include an imaging station 22 for imagewise depositing electrostatic charge on layer 14 according to the video information being recorded, a development station 24 for applying marking particles (e.g. conventional electrographic toner particles) to the dielectric surface to render such electrostatic images visible, and a transfer station 26 for transferring the particle images from the dielectric surface of recording element paper web 20. A cleaning station 28 comprising a rotatably driven brush 29 serves to remove residual marking particles from the dielectric surface of the recording element prior to recycling of the recording element to produce additional transferrable images.

Development station 24 and transfer station 26 are of conventional design, being of the type used in conventional electrostatographic copiers. Development station 24 is depicted as being of the magnetic brush variety, comprising a magnetic cylinder 30 which rotates in a reservoir containing a mixture of iron filings and pigmented particles (i.e. toner), the latter being electrostatically charged so as to be attractive to those portions of the electrostatic image which are to be rendered visible. Typically, cylinder 30 is connected to a DC bias supply 32 and thereby acts as a development electrode to enhance solid area development and to minimize the deposition of toner in the background areas of the image. Transfer station 26 comprises an electrically conductive pressure roller 40 which is electrically biased by bias supply 42 to attract the marking particles toward the paper web 20. Upon being transferred to web 20, the marking particles are permanently fused thereto at fusing station 44.

Electrostatic imaging station 22 generally includes a recording head comprising one or more electrically conductive styli to which electrical signals are applied from a video source. The stylus (or styli) is positioned sufficiently close to the dielectric surface that an electrical discharge occurs between the tip of the stylus and the conductive backing of the recording element when a signal of approximately 500 volts is applied to the stylus.

The particular recording head illustrated in FIGS. 1 and 2 is merely exemplary of those that may be used in the practice of the invention. Such recording head comprises a movably mounted paddle 52 which supports a plurality of uniformly spaced, electrically conductive wire styli 53. Paddle 52 includes a pivotally mounted lever arm 54 having a block 55 of dielectric material attached to one end thereof. Block 55 is provided with grooves 59 (see FIG. 3) on its top, side and bottom surfaces, 56, 57, 58, respectively, to receive and maintain the uniform spacing of the individual styli. Each stylus may comprise, for instance, a tungsten or nichrome wire of substantially circular cross section having a 0.004 inch diameter. A groove spacing in block 55 of 0.005 from center-to-center provides a one mil spacing between adjacent styli and a packing density of 200 styli per inch. One end of each wire stylus is electrically coupled to a video signal source, such as through the discrete circuitry depicted in FIG. 4 (discussed below); the opposite end is bonded to the dielectric block 55 by an adhesive. Electronic control means (not shown) serve to pivot paddle 52 about fulcrum 60 between an inoperable position, in which block 55 is spaced from dielectric layer 14, and an operable position in which edge **56*a* of block 55 is positioned such that that portion of each stylus which bends over edge 56*a*** contacts the dielectric surface of the recording element. By this arrangement, electrical discharge is made from the rounded sides of each stylus, rather than from its end.

Referring to the enlarged cross-sectional view of the recording head depicted in FIG. 3, the discharge pattern from each stylus can be visualized. The potential lines P are shown in solid lines and the electric field lines E are shown in dashed lines, both being shown as they occur before the air gap is broken down, when all styli are at the same potential. It should be noted that there is a vertical (zero) electric field line between adjacent styli. Due to the absence of an electric field between adjacent styli, the discharges of the styli are isolated from each other, the result being a reduction in cross talk effects. When a sufficient voltage is applied to a stylus, a discharge will occur between the stylus and the grounded conductive core 12. This discharge will follow the field lines, starting in the regions under the styli where the field is high enough to initiate the discharge, and filling out the area beneath the stylus to a field line where the field is insufficient to sustain a discharge.

Referring now to FIG. 4, preferred circuitry for driving each stylus 53 is shown schematically. Such circuitry is in the nature of a passive summing circuit which acts to sum, at point B, a fixed frequency RF signal and a DC signal, the latter having an amplitude which is modulated by the analog output of a video source. The RF signal is provided by a conventional RF signal generator 61 having a fixed frequency between 0.1 and 0.5 MHz. Amplifier A and transformer T serve to amplify the output of the RF generator to a peak value of approximately 500 volts. A coupling capacitor C can be used to eliminate any DC component which might arise in the RF signal. When the styli are positioned in contact with the dielectric surface of the recording element and a 500 volt RF signal is applied thereto, an electrical discharge will occur in the vicinity of the styli during each half-cycle of the RF signal. As indicated above, an electrical discharge will produce relatively massive positively-charged gas ions in the vicinity of the stylus and, due to the RF field, such ions will be alternately accelerated toward, and thereby bombard, the dielectric surface and the styli. Gradually, such ion bombardment will wear a groove in the dielectric surface, resulting in a serious degradation in quality of the images produced. Further, such ion bombardment will tend to gradually wear down the styli, further reducing image quality.

Now, in accordance with the present invention, the aforementioned benefits of an RF bias are retained while the aforementioned disadvantages of dielectric wear are virtually eliminated by the provision of means for negatively biasing each stylus so that, during the application of the RF field, the stylus is always more attractive to positive ions than the dielectric surface. As may be readily appreciated, circuitry for negatively biasing the styli may take any one of a variety of forms. In FIG. 4, for instance, negative biasing of the styli is achieved by a separate DC power supply connected in series with the output of the source of video information. Resistor R serves merely to decouple the RF signal from the video source. A suitable video source is disclosed in an article by Hayashi et al in IEEE Transactions on Electron Devices, Vol. ED 19, No. 4, P. 543–547 (1972).

Use of a circuit such as shown in FIG. 4 results in a waveform such as that illustrated in FIG. 5. Referring to FIG. 5, when the applied stylus voltage exceeds the socalled "Paschen" voltage, $V_p$, air in the vicinity of the stylus/dielectric interface becomes ionized. Because the stylus voltage is negative with respect to the grounded conductive core 12 of the recording element, positive ions from the ionized air will be attracted toward the stylus, and electrons will be attracted toward the dielectric surface of the recording element, thereby charging such surface. Note, negative charge will be deposited on the dielectric surface even in the absence of a video signal. When the stylus voltage is less than the Paschen voltage, there will be no electrical discharge. When a video signal is superimposed on the RF bias, more positive ions and free electrons are produced during each negative half-cycle, the result being that more negative charge is deposted on the dielectric surface. Those areas on the dielectric surface which receive the additional charge represent the image areas of the video image being recorded.

To prevent the lesser charged background areas of the video image from being developed at development station 24, the development electrode bias potential provided by DC source 32 is selected to be substantially equal to, or slightly greater than the charge potential of the background areas. Under the influence of such bias, positively charged toner particles will be attracted more toward the development brush than towards the background areas of the image.

Figure 8:
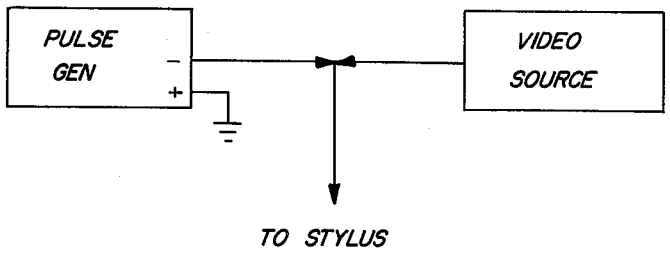
FIG. 8 is an electrical schematic of circuitry for producing the waveform depicted in FIG. 7.

While the above technique has been found to substantially eliminate recording element wear due to ion bombardment, it is evident that the stylus tips are subjected to wear by ion bombardment. It has been found that stylus wear can be minimized by substituting for the sinusoidal waveform of the RF bias shown in FIG. 5, a pulse train having a limited duty cycle; the duty cycle of a pulse train is defined as the ratio of the pulse duration to the period between pulses. Referring to FIG. 6, as the stylus voltage V gradually becomes more negative and exceeds the Paschen voltage, charge Q on the dielectric surface increases rapidly and saturates in a time $\Delta t$. Thus, only during time $\Delta t$ is charge deposited on the dielectric surface of the recording element. During the remaining portion of the RF cycle while the stylus voltage exceeds the Paschen voltage, no additional charging of the dielectric takes place; nonetheless, the stylus continues to be subjected to ion bombardment. By applying an RF bias in the form of a pulse train, each pulsewidth being equal to or slightly greater than $\Delta t$, it is possible to charge the dielectric to substantially the same extent as that achieved by using an RF bias with a sinusoidal waveform, while minimizing the time period during which the stylus is subjected to ion bombardment. A typical waveform of the voltage applied to the stylus is depicted in FIG. 7. Note, the rate at which the dielectric surface becomes charged is actually much faster than that shown in FIG. 6. In fact, it has been found that a pulse train having a duty cycle of only 3% will produce approximately the same charging effect as a sinusoidal signal having the same peak-to-peak amplitude. Significant reduction in stylus wear can be achieved by using a pulse train having a duty cycle of approximately 25% or less. Circuitry for producing the waveform depicted in FIG. 7 is illustrated in block diagram form in FIG. 8. Pulse generator 70 is of conventional design, such as the Vellonix, Model 350, Pulse Generator.

The invention has been described in detail with particular reference to certain preferred embodiments thereof, but it will be understood that variations and modifications can be effected within the spirit and scope of the invention.

What is claimed is:

1. In an electrostatic stylus recorder of the type including (a) a recording element comprising a dielectric layer disposed on an electrically conductive member; (b) an electrically conductive stylus, said stylus being mounted adjacent said dielectric layer; (c) circuit means for producing an RF field between said stylus and said conductive member, said RF field being of sufficient intensity to ionize air molecules in the vicinity of said stylus and thereby produce an air plasma comprising positively-charged ions; and (d) means for applying a video signal to said stylus to cause said stylus to imagewise charge said dielectric layer; the improvement comprising:

means for electrically biasing said stylus to a negative potential relative to said conductive member, said biaising means comprising a DC voltage source operatively connected to said circuit means and to said stylus, said bias being sufficient to render said stylus more attractive to said positively-charged ions than said conductive member at all times said RF field is produced, whereby said positively-charged ions are prevented from impacting upon said dielectric layer.

2. The invention as defined in claim 1 wherein said circuit means comprises an RF signal generator operatively connected to said stylus.

3. The invention as defined in claim 1 wherein said circuit means comprises a pulse generator for generating a train of pulses having a duty cycle less tha approximately 25%.

4. In an electrostatic stylus recorder of the type including (a) a recording element comprising a dielectric layer having an electrically conductive backing; (b) an electrically conductive stylus positionable adjacent said dielectric layer, said stylus being adapted to deposit electrostatic charge on said layer upon having electrical signals applied thereto; and (c) developing means for applying charged marking particles to said layer to render said electrostatic charges visible; the improvement comprising (d) first circuit means for producing an RF field between said stylus and said conductive backing, said RF field being sufficient to ionize air molecules in the vicinity of said stylus and thereby produce an air plasma comprising positively-charged ions; (e) second circuit means for DC biasing said stylus to be more attractive to said positively-charged ions than said conductive backing at all times said RF field is produced, whereby said dielectric layer receives a substantially uniform electrostatic charge; and (f) means for controlling the application of marking particles to said layer in response to the level of said uniform charge, whereby marking particles are applied only to those areas of the dielectric layer which receive charge from said stylus in addition to said uniform charge.

5. The invention as defined in claim 4 wherein said first circuit means comprises a pulse generator for generating a train of pulses having a duty cycle less than approximately 25%.

6. The invention as defined in claim 4 further comprising means for summing the outputs of said first and second circuit means.

7. In a method of forming electrostatic images on a dielectric layer disposed on a conductive member, such method comprising the steps of (a) producing an RF field between an electrically conductive stylus and said conductive member, such RF field being sufficient to ionize air molecules between said stylus and said conductive member and thereby produce positively-charged ions and free electrons, (b) selectively applying electrical signals to said stylus to cause an imagewise deposition of charge on said dielectric layer, and (c) selectively biasing said conductive member relative to said stylus to be more attractive to free electrons than to positive ions, whereby a net negative charge is selectively deposited on said dielectric layer, the improvement comprising the step of:

applying a substantially constant negative DC bias to said stylus, said negative bias being sufficient to render said stylus at all times more attractive to said RF-produced positively-charged ions than is said conductive member, whereby said positively-charged ions are prevented from bombarding, and thereby abrading, said dielectric layer while said RF field is produced.

* * * * *